US008258889B2

(12) United States Patent
Fluhrer

(10) Patent No.: US 8,258,889 B2
(45) Date of Patent: Sep. 4, 2012

(54) BROADBAND DIRECTIONAL COUPLER WITH ADJUSTABLE DIRECTIONALITY

(75) Inventor: Christoph Fluhrer, Neuried (DE)

(73) Assignee: Rohde & Schwarz GmbH & Co. KG, München (DE)

( * ) Notice: Subject to any disclaimer, the term of this patent is extended or adjusted under 35 U.S.C. 154(b) by 269 days.

(21) Appl. No.: 12/594,971

(22) PCT Filed: Jun. 12, 2008

(86) PCT No.: PCT/EP2008/004726

§ 371 (c)(1),
(2), (4) Date: Nov. 30, 2009

(87) PCT Pub. No.: WO2009/000431

PCT Pub. Date: Dec. 31, 2008

(65) Prior Publication Data

US 2010/0134201 A1 Jun. 3, 2010

(30) Foreign Application Priority Data

Jun. 25, 2007 (DE) ..... 10 2007 029 125

(51) Int. Cl.
*H01P 5/18* (2006.01)
*H01P 3/08* (2006.01)

(52) U.S. Cl. ..... 333/116; 333/238

(58) Field of Classification Search ..... 333/109, 333/116, 238, 246
See application file for complete search history.

(56) References Cited

U.S. PATENT DOCUMENTS

| | | | | |
|---|---|---|---|---|
| 3,798,575 | A * | 3/1974 | De Brecht et al. | 333/116 |
| 4,591,812 | A | 5/1986 | Stegens et al. | |
| 5,105,171 | A * | 4/1992 | Wen et al. | 333/116 |
| 5,689,217 | A | 11/1997 | Gu et al. | |
| 5,767,753 | A * | 6/1998 | Ruelke | 333/116 |
| 6,859,177 | B2 | 2/2005 | Pozdeev | |
| 7,009,467 | B2 * | 3/2006 | Sawicki | 333/116 |
| 7,425,877 | B2 * | 9/2008 | Casper et al. | 333/116 |
| 2007/0120621 | A1 | 5/2007 | Kirkeby | |

FOREIGN PATENT DOCUMENTS

| | | | |
|---|---|---|---|
| GB | 2071922 | A | 9/1981 |
| JP | 56086505 | A | 7/1981 |
| WO | WO-03009414 | A1 | 1/2003 |
| WO | WO-03047024 | A1 | 6/2003 |

OTHER PUBLICATIONS

International Search Report for PCT/EP2008/004726 dated Aug. 12, 2008.

Tripathi, "The scattering parameters and directional coupler analysis of characteristically terminated three-line structures in an inhomogeneous medium," *IEEE Transactions on Microwave Theory and Techniques*, 29:22-26 (1981).

* cited by examiner

*Primary Examiner* — Dean O Takaoka
(74) *Attorney, Agent, or Firm* — Marshall, Gerstein & Borun LLP

(57) ABSTRACT

A directional coupler for the directional transmission of high-frequency signals provides at least three lines and at least three ports. Two lines of the three lines are connected in a conductive manner at least at their ends. A third line is arranged between the two first lines and coupled to the latter in an electromagnetic manner. In this context, the high-frequency signal is transmitted from the third line to the first line and second line. The coupling is implemented via a coupling gap.

16 Claims, 5 Drawing Sheets

BROADBAND DIRECTIONAL COUPLER WITH ADJUSTABLE DIRECTIONALITY

BACKGROUND OF THE INVENTION

1. Field of the Invention

The invention relates to a directional coupler with directional transmission of high-frequency signals.

2. Related Technology

Coupled lines are conventionally used in directional couplers. In this context, reference is made, for example, to U.S. Pat. No. 5,689,217. However, with a conventional single-layer structure on a printed circuit board, only a low sharpness of directivity can be achieved. With the conventional structure, a sharpness of directivity of more than 30 dB can be achieved only with a structure of at least three layers or with a mechanically very complex structure or with an explicit optimization during manufacture of the sharpness of directivity of each individual directional coupler.

SUMMARY OF THE INVENTION

The invention provides a directional coupler, which provides a high sharpness of directivity within a required frequency range at low cost and with compact dimensions of the circuit structure.

Accordingly, the invention provides a directional coupler with at least three lines and at least three ports for the directional transmission of high-freguency signals, wherein a first line and a second line are connected in a conductive manner at least at their two ends, wherein a third line is arranged between the first line and the second line, wherein the third line is coupled in an electromagnetic manner to the first line and to the second line, so that the high-freguency signal is transmitted from the first and second line to the third line, wherein the coupling of the third line to the first line and the second line is implemented via at least one coupling gap.

The directional coupler according to the invention provides at least three lines and at least three ports. Two of the three lines are connected in a conductive manner at least at their ends. A first line is arranged between the first and second line and coupled electromagnetically to the latter. In this context, the high-frequency signal is transmitted from the third line to the first line and the second line. The coupling is implemented across a coupling gap. The coupling area increased by the three coupled lines allows a compact construction of the circuit with a good sharpness of directivity.

The directional coupler is advantageously constructed using stripline technology. A structure using widely-available stripline technology ensures compatibility with other circuits constructed using this technology within the respective application of the same substrate. Furthermore, this technology is characterized by a low cost for the circuit structure.

The frequency response of the sharpness of directivity is advantageously determined by selecting the width of the lines and/or of the coupling gap. Accordingly, a simple adjustability of the frequency-dependent sharpness of directivity is possible during the design process.

The first and the second line advantageously provide at least one common port. The first line advantageously provides at least two ports. This structure allows the signals to be impressed and picked up.

The transmission of signals from at least one first port of the third line to at least one port of the first and second line is advantageously, at most, weakly attenuated. The transmission of signals from at least one second port of the third line to at least one port of the first and second line is advantageously strongly attenuated. A high sharpness of directivity can be achieved in this manner.

By preference, the third line is connected in a conductive manner to a fourth line and a fifth line at least at their ends. In this context, the fourth and fifth line are preferably arranged parallel and outside of the first and second line. The fourth and fifth line are advantageously separated from the first and second line by coupling gaps. An increase in the number of lines increases the coupling area. This significantly increases the sharpness of directivity with a cost and space requirement for the circuit structure, which is not significantly increased.

The first and second line are advantageously connected in a conductive manner to several further lines at least at their ends. The first line is also advantageously connected in a conductive manner to several further lines at least at their ends. By preference, the several further lines extend parallel and outside of the first and second lines and are each separated by coupling gaps. A line connected to the first and second line and a line connected to the third line are advantageously positioned in an alternating manner at the side of the first and second line facing away from the third line. An arbitrary number of further coupling lines further increases the sharpness of directivity without significantly increasing the cost and space requirement of the circuit structure.

The directional coupler is advantageously constructed on the front side of the substrate. The rear side of the substrate is advantageously metallized and provides a reference potential. All lines connected to the third line are advantageously connected via through-contacts to the rear side of the substrate, wherein the metallization is interrupted around the connections of the through-contacts. By connecting the lines on the rear side of the substrate, a more costly manufacturing process is avoided. This structure allows a high sharpness of directivity at low cost and with small dimensions of the structure.

BRIEF DESCRIPTION OF THE DRAWINGS

The invention is described by way of example below with reference to the drawings, in which an advantageous exemplary embodiment of the invention is illustrated. The drawings are as follows.

DETAILED DESCRIPTION

The circuit-technology structure and function of the directional coupler according to the invention is explained with reference to FIGS. 1-7. In some cases, the presentation and description of identical elements has not been repeated in similar drawings.

Figure 1:
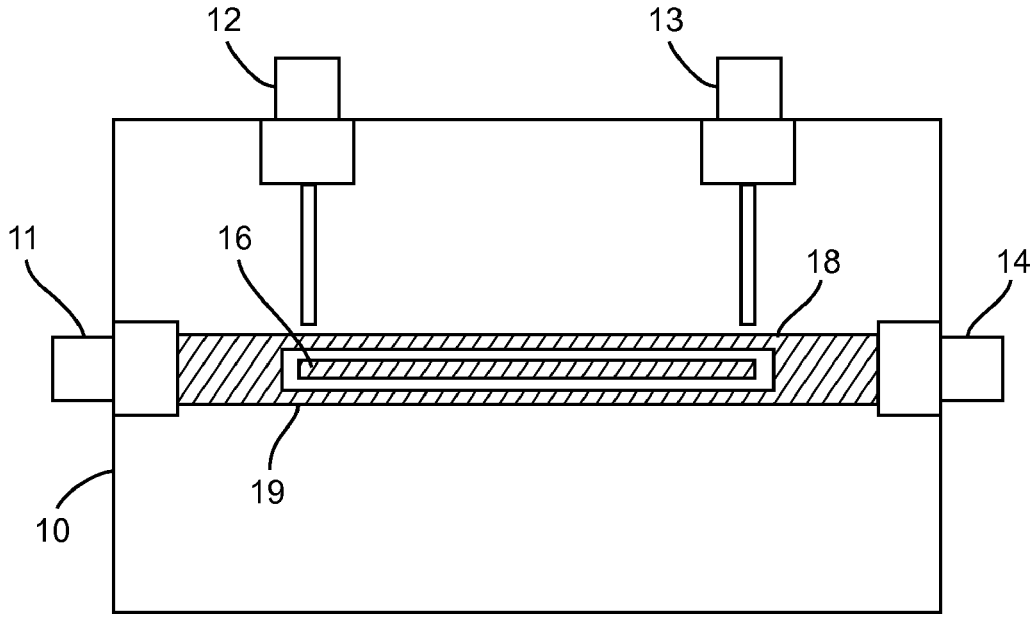
FIG. 1 shows an exemplary presentation of the front side of the first exemplary embodiment of the directional coupler according to the invention.

FIG. 1 shows an exemplary presentation of the front side of a first exemplary embodiment of the directional coupler according to the invention. The lines 16, 18 and 19 are applied to a substrate 10 using stripline technology. In this context, the line 16 is connected to the coaxial ports 12 and 13, as described in greater detail with reference to FIG. 2. The lines 18 and 19 are also connected to one another in a conductive manner. Accordingly, on the upper side of the substrate 10, a non-metallized window is formed, which is surrounded on all sides by the lines 18 and 19, and in which the first line 16 is arranged in such a manner that it nowhere touches the first line 18 and the second line 19 on the upper side.

The lines 18 and 19 provide the two common coaxial ports 11 and 14. The desired coupling direction of the directional coupler in this context extends from coaxial port 11 to coaxial port 12 and from coaxial port 14 to coaxial port 13. The function of the directional coupler is described in greater detail with reference to FIG. 3.

Figure 2:
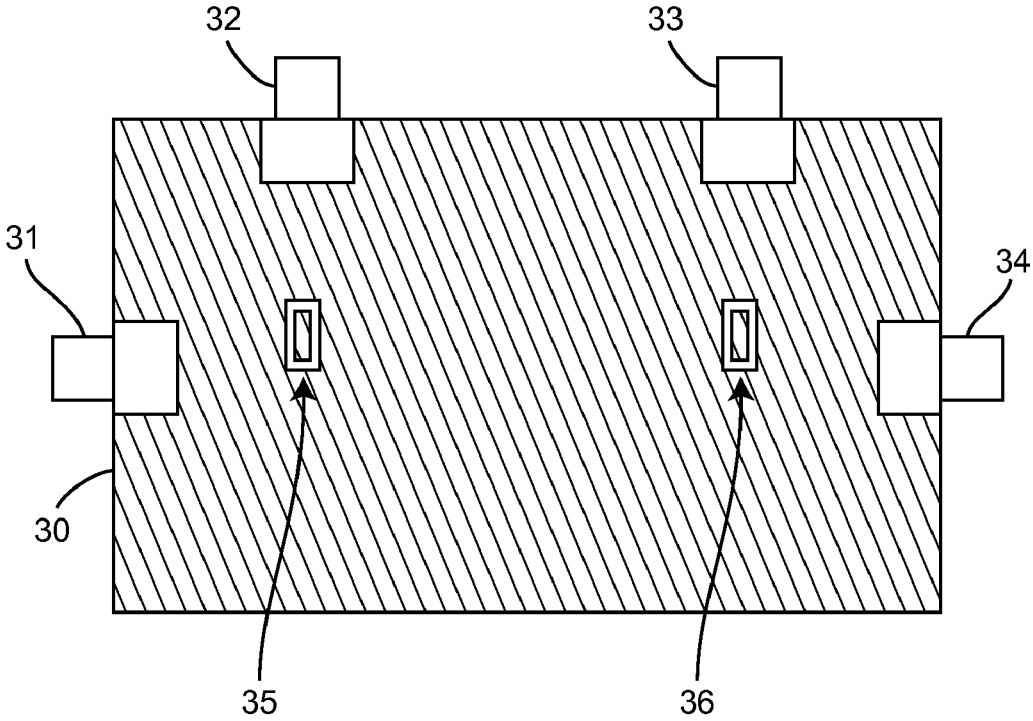
FIG. 2 shows an exemplary presentation of the rear side of the first exemplary embodiment of the directional coupler according to the invention.

In FIG. 2, an exemplary presentation of the rear side of the first exemplary embodiment of the directional coupler according to the invention is presented. The rear side of the substrate 10 named with reference to FIG. 1 is metallized over the entire surface. The line 16 from FIG. 1 is guided by means of through-contacts to the rear side 30 of the substrate 10. Here, the through-contacts are connected in a conductive manner to through-contacts of the coaxial ports 32 and 33 within regions 35 and 36 insulated from the metallization.

Figure 3:
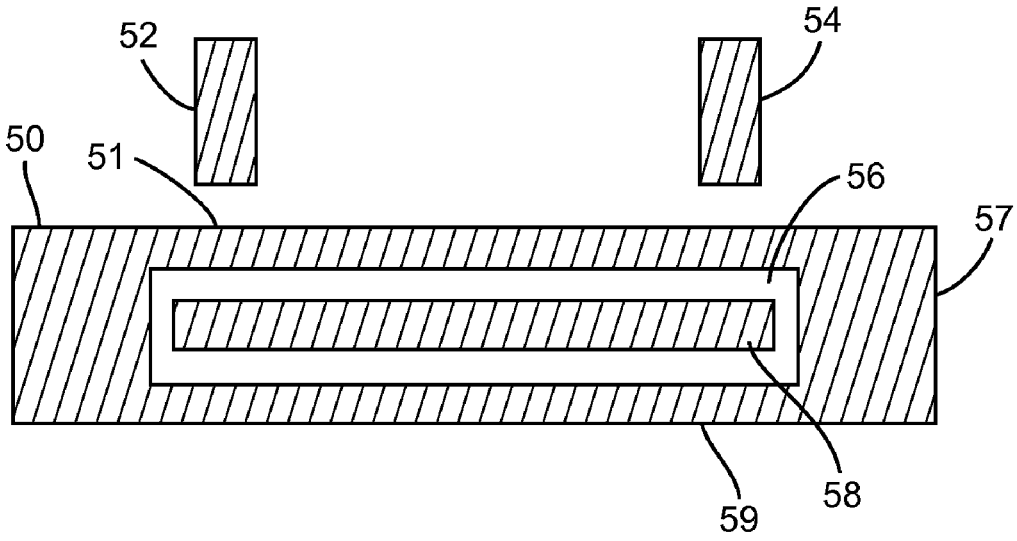
FIG. 3 shows an exemplary presentation of details of the front side of the first exemplary embodiment of the directional coupler according to the invention.

FIG. 3 shows an exemplary presentation of details of the front side of the first exemplary embodiment of the directional coupler according to the invention. The conductor 58 is connected in a conductive manner to the contacts 52 and 54. The lines and 51 and 59 are also connected in a conductive manner. The contacts 50, 52, 54 and 57 lead to the coaxial ports 11, 12, 13 and 14 described with reference to FIG. 1. The named lines 51, 58 and 59 are separated from one another by the coupling gap 56. The frequency response of the sharpness of directivity of the directional coupler is adjusted by specifying the width of the coupling gap 56 and/or the width of the lines 51, 58 and 59. Because of the large available coupling area through the several lines 51, 58 and 59, a high sharpness of directivity can be achieved with a compact structure of the directional coupler on only one substrate layer.

Figure 4:
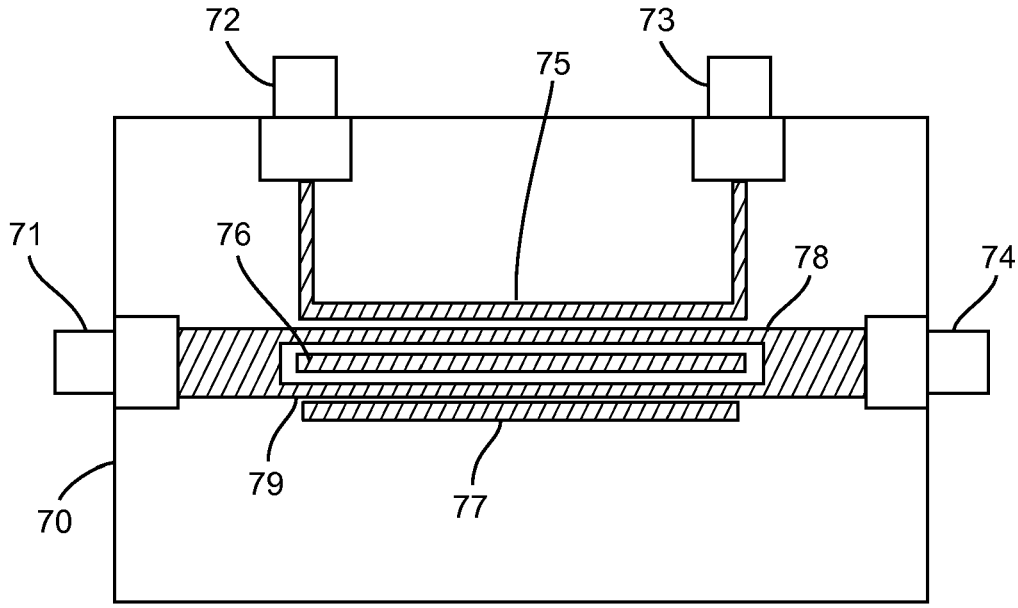
FIG. 4 shows an exemplary presentation of the front side of a second exemplary embodiment of the directional coupler according to the invention.

FIG. 4 shows an exemplary presentation of the front side of a second exemplary embodiment of the directional coupler according to the invention. The lines 75, 76, 77, 78 and 79 are applied to a substrate 70 using stripline technology. In this context, the lines 75, 76 and 77 are connected to the coaxial ports 72 and 73 as described in greater detail with reference to FIG. 5. The lines 78 and 79 are also connected to one another in a conductive manner. The lines 78 and 79 provide the two common coaxial ports 71 and 74. The desired coupling direction of the directional coupler extends in this context from coaxial port 71 to coaxial port 72 and from coaxial port 74 to coaxial port 73. The function of the directional coupler is described in greater detail with reference to FIG. 6.

Figure 5:
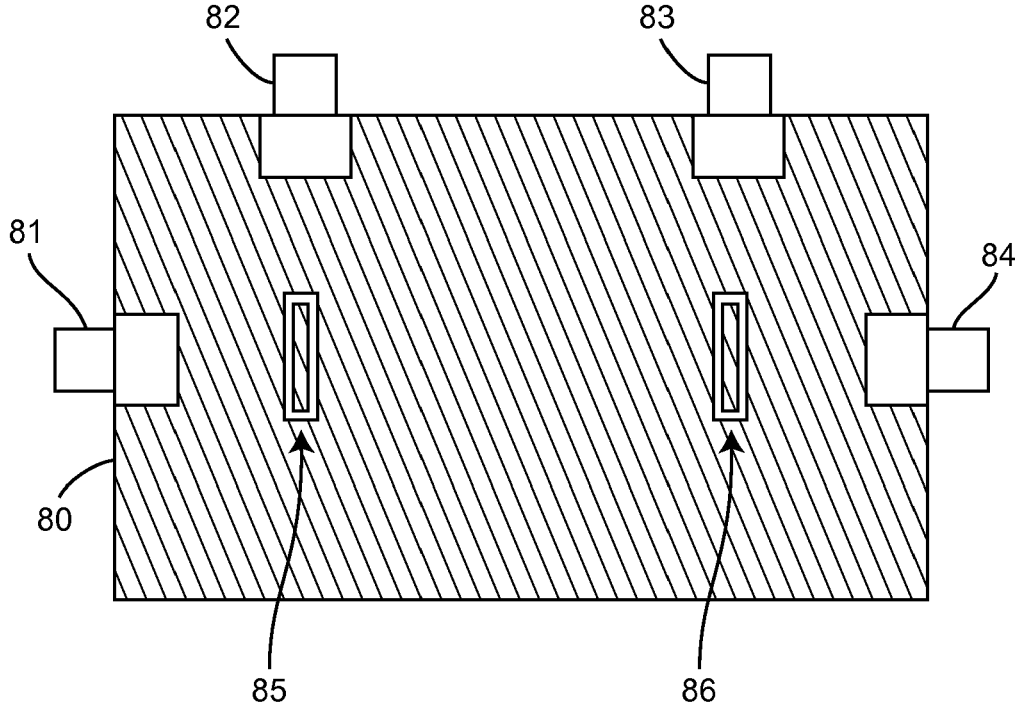
FIG. 5 shows an exemplary presentation of the rear side of the second exemplary embodiment of the directional coupler according to the invention.

In FIG. 5, an exemplary presentation of the rear side of the second exemplary embodiment of the directional coupler according to the invention is presented. The rear side 80 of the substrate 70 named with reference to FIG. 4 is metallized over the entire surface. The lines 75, 76 and 77 from FIG. 3 are guided by means of through-contacts to the rear side 80 of the substrate 70. Here, the through-contacts are connected to one another in a conductive manner and connected to through-contacts of the coaxial ports 82 and 83 within regions 85 and 86 insulated from the metallization.

Figure 6:
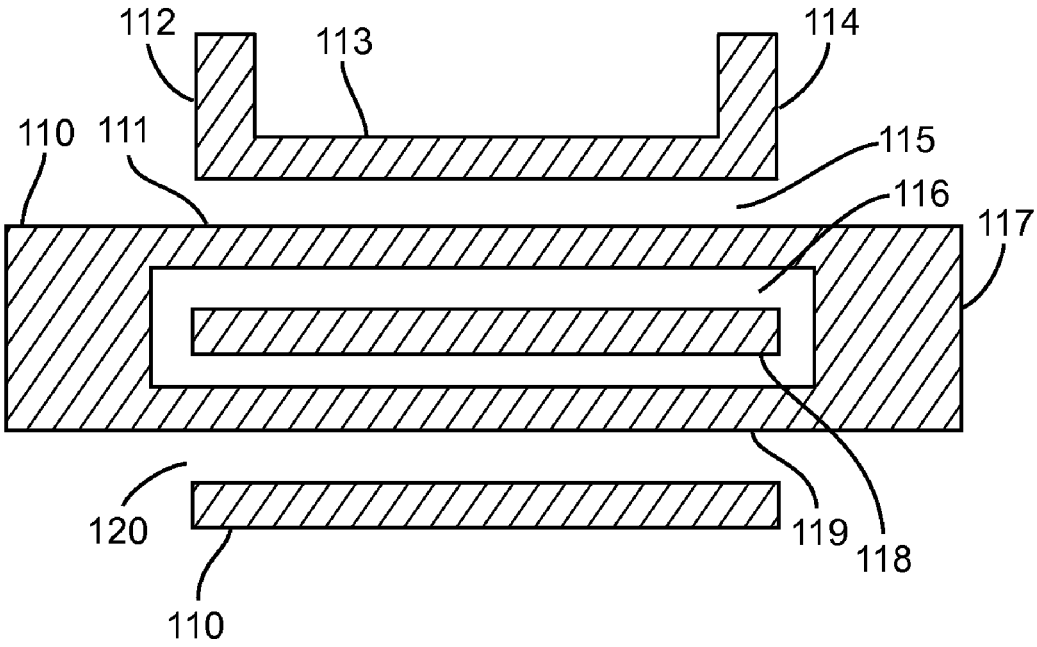
FIG. 6 shows an exemplary presentation of details of the front side of the second exemplary embodiment of the directional coupler according to the invention.

FIG. 6 shows an exemplary presentation of details of the front side of the second exemplary embodiment of the directional coupler according to the invention. The lines 110, 113 and 118 are connected in a conductive manner to the contacts 112 and 114. The lines 111 and 119 are also connected in a conductive manner. The contacts 110, 112, 114 and 117 lead to the coaxial ports 71, 72, 73 and 74 described with reference to FIG. 4. The named lines 110, 113 and 118 are separated by coupling gaps 115, 116 and 120 from the lines 111 and 119. The frequency response of the sharpness of directivity of the directional coupler is adjusted by specifying the width of the coupling gaps 115, 116 and 120 and/or the width of the lines 110, 111, 113, 118 and 119. Because of the large coupling area available through the several lines 110, 111, 113, 118 and 119, a high sharpness of directivity can be achieved with a compact structure of the directional coupler on only one substrate layer.

Figure 7:
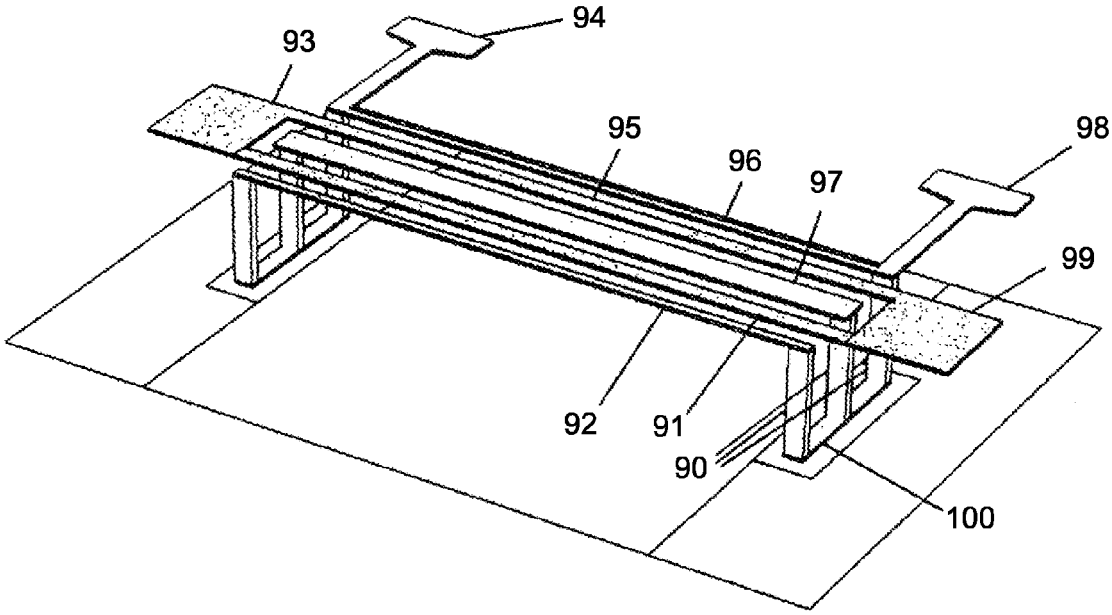
FIG. 7 shows an exemplary three-dimensional presentation of the second exemplary embodiment of the directional coupler according to the invention.

In FIG. 7, an exemplary three-dimensional presentation of the second exemplary embodiment of the directional coupler according to the invention is presented. In this context, the scaling of the axes does not correspond to the scaling of the preceding presentations. In particular, in FIG. 7, the vertical dimension is considerably stretched by comparison with the horizontal dimensions in the plane of the substrate, so that the through-contacts 90 are more readily recognizable. The striplines 92, 96 and 97 are connected in a conductive manner via the through-contacts 90 and the connection 100 on the rear side of the substrate to one another and to the contacts 94 and 98. The striplines 91 and 95 are connected on the front side of the substrate to one another and to the contacts 93 and 99. The coupling is implemented from port 93 to port 94 and from port 99 to port 98.

The invention is not restricted to the exemplary embodiment presented. For example, further different components influencing the frequency response of the sharpness of directivity can be used. A use of the structure in multi-layer printed circuit boards is also conceivable. A further increase in the number of lines used for the coupling is also possible. All of the features described above or features illustrated in the drawings can be combined with one another as required within the framework of the invention.

The invention claimed is:

1. A directional coupler with at least three lines and at least three ports for the directional transmission of high-frequency signals, wherein a first line and a second line are connected in a conductive manner at least at their two ends, wherein:

a third line is arranged between the first line and the second line, the third line is coupled in an electromagnetic manner to the first line and to the second line, so that the high-frequency signal is transmitted from the first and second line to the third line, and the coupling of the third line to the first line and the second line is implemented via at least one coupling gap, wherein the third line is connected in a conductive manner to a fourth line and a fifth line at least at ends thereof, the fourth line and the fifth line are arranged parallel to the third line, and the fourth line or respectively the fifth line extend on the side of the first line or respectively the second line facing away from the third line, and that the fourth line and the fifth line is separated by coupling gaps from the first line and the second line, wherein the directional coupler is constructed using stripline technology, wherein:

the directional coupler is constructed on a front side of a substrate, a rear side of the substrate is metallized, the metallized rear side of the substrate is disposed at a reference potential, the connections of the third line to all of the lines connected to it in a conductive manner are realized by through-contacts to the substrate rear side, wherein the through-contacts are connected in a conductive manner, and the metallization of the substrate rear side is interrupted around the connections of the through-contacts.

2. The directional coupler according to claim 1, wherein a frequency characteristic of the sharpness of directivity of the directional coupler is adjusted through a width of the coupling gap between the third line and the first line and the second line and/or a width of the three lines.

3. The directional coupler according to claim 1, wherein the first line and the second line provide at least two common ports, and the third line provides at least one port.

4. The directional coupler according to claim 3, wherein the transmission of signals from the first port of the first line and the second line to the at least one port of the third line is only weakly attenuated, and the transmission of signals from a second port of the first line and the second line to the at least one port of the third line is strongly attenuated.

5. The directional coupler according to claim 1, wherein the first line and the second line are connected in a conductive manner to several further lines at least at ends thereof, the third line is connected in a conductive manner to several further lines at least at ends thereof, the several further lines are arranged parallel to the third line, the several further lines are arranged at the side of the first line or respectively of the second line facing away from the third line, and at the side of the first line and of the second line facing away from the third line, a line connected to the first line and to the second line and a line connected to the third line is placed in an alternating manner separated by a coupling gap.

6. The directional coupler according to claim 1, wherein the reference potential is ground potential.

7. A directional coupler with at least three lines and at least three ports for the directional transmission of high-frequency signals, wherein a first line and a second line are connected in a conductive manner at least at their two ends, wherein:

a third line is arranged between the first line and the second line, the third line is coupled in an electromagnetic manner to the first line and to the second line, so that the high-frequency signal is transmitted from the first and second line to the third line, and the coupling of the third line to the first line and the second line is implemented via at least one coupling gap, wherein the first line and the second line are connected in a conductive manner to several further lines at least at ends thereof, the third line is connected in a conductive manner to several further lines at least at ends thereof, the several further lines are arranged parallel to the third line, the several further lines are arranged at the side of the first line or respectively of the second line facing away from the third line, and at the side of the first line and of the second line facing away from the third line, a line connected to the first line and to the second line and a line connected to the third line is placed in an alternating manner separated by a coupling gap, wherein the directional coupler is constructed using stripline technology, wherein:

the directional coupler is constructed on a front side of a substrate, a rear side of the substrate is metallized, the metallized rear side of the substrate is disposed at a reference potential, the connections of the third line to all of the lines connected to it in a conductive manner are realized by through-contacts to the substrate rear side, wherein the through-contacts are connected in a conductive manner, and the metallization of the substrate rear side is interrupted around the connections of the through-contacts.

8. The directional coupler according to claim 7, wherein a frequency characteristic of the sharpness of directivity of the directional coupler is adjusted through a width of the coupling gap between the third line and the first line and the second line and/or a width of the three lines.

9. The directional coupler according to claim 7, wherein the first line and the second line provide at least two common ports, and the third line provides at least one port.

10. The directional coupler according to claim 9, wherein the transmission of signals from the first port of the first line and the second line to the at least one port of the third line is only weakly attenuated, and the transmission of signals from a second port of the first line and the second line to the at least one port of the third line is strongly attenuated.

11. The directional coupler according to claim 7, wherein the reference potential is ground potential.

12. A directional coupler with at least three lines and at least three ports for the directional transmission of high-frequency signals, wherein a first line and a second line are connected in a conductive manner at least at their two ends, wherein:

a third line is arranged between the first line and the second line, the third line is coupled in an electromagnetic manner to the first line and to the second line, so that the high-frequency signal is transmitted from the first and second line to the third line, and the coupling of the third line to the first line and the second line is implemented via at least one coupling gap, wherein the directional coupler is constructed using stripline technology, the directional coupler is constructed on a front side of a substrate, a rear side of the substrate is metallized, the metallized rear side of the substrate is disposed at a reference potential, the connections of the third line to all of the lines connected to it in a conductive manner are realized by through-contacts to the substrate rear side, wherein the through-contacts are connected in a conductive manner, and the metallization of the substrate rear side is interrupted around the connections of the through-contacts.

13. The directional coupler according to claim 12, wherein a frequency characteristic of the sharpness of directivity of the directional coupler is adjusted through a width of the coupling gap between the third line and the first line and the second line and/or a width of the three lines.

14. The directional coupler according to claim 12, wherein the first line and the second line provide at least two common ports, and the third line provides at least one port.

15. The directional coupler according to claim 14, wherein the transmission of signals from the first port of the first line and the second line to the at least one port of the third line is only weakly attenuated, and the transmission of signals from a second port of the first line and the second line to the at least one port of the third line is strongly attenuated.

16. The directional coupler according to claim 15, wherein the reference potential is ground potential.

* * * * *